US008567996B2

(12) United States Patent
Hartwig et al.

(10) Patent No.: US 8,567,996 B2
(45) Date of Patent: Oct. 29, 2013

(54) REDUCTION OF THE POWER INTRODUCED INTO THE ELECTRODE OF A DISCHARGE LAMP BY BACK-REFLECTION

(75) Inventors: Ulrich Hartwig, Berlin (DE); Andre Nauen, Jiangsu (CN)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 449 days.

(21) Appl. No.: 13/022,674

(22) Filed: Feb. 8, 2011

(65) Prior Publication Data

US 2011/0194290 A1 Aug. 11, 2011

(30) Foreign Application Priority Data

Feb. 8, 2010 (DE) ..... 10 2010 001 665

(51) Int. Cl.
*F21V 7/04* (2006.01)

(52) U.S. Cl.
USPC ..... 362/296.01; 362/350

(58) Field of Classification Search
USPC ..... 362/296.01, 310, 296.05, 350
See application file for complete search history.

(56) References Cited

U.S. PATENT DOCUMENTS

| | | | | |
|---|---|---|---|---|
| 5,806,971 | A * | 9/1998 | Sugihara et al. | 362/264 |
| 7,224,107 | B2 | 5/2007 | Moench et al. | |
| 2009/0262313 | A1 | 10/2009 | Rehn | |

FOREIGN PATENT DOCUMENTS

| | | | |
|---|---|---|---|
| DE | 10151267 | A1 | 4/2003 |
| DE | 102008019648 | A1 | 10/2009 |

* cited by examiner

*Primary Examiner* — David V Bruce

(57) ABSTRACT

An illumination unit including a discharge lamp is provided. The discharge lamp may have an electrode, and a reflector with a reflective surface and an optical axis, the electrode having in a sectional plane, which includes the optical axis, a sectional area, and a projection of the reflective surface of one of the halves of the reflector that are separated by the section perpendicularly into the sectional plane along optical paths that are free for the light of the illumination unit resulting in a projected area, wherein the overlap of the projected area and the sectional area is smaller than the area of the electrode in a plane which is perpendicular to the sectional plane and includes the optical axis.

20 Claims, 5 Drawing Sheets

REDUCTION OF THE POWER INTRODUCED INTO THE ELECTRODE OF A DISCHARGE LAMP BY BACK-REFLECTION

CROSS-REFERENCE TO RELATED APPLICATION

This application claims priority to German Patent Application Serial No. 10 2010 001665.9, which was filed Feb. 8, 2010, and is incorporated herein by reference in its entirety.

TECHNICAL FIELD

Various embodiments relate to an illumination unit including a discharge lamp with an electrode and a reflector, the illumination unit being designed such that it reduces the power introduced into the electrode by back-reflection. Various embodiments also relate to the use of such an illumination unit with a following optical system.

BACKGROUND

In the case of high-pressure discharge lamps, the light is produced when current passes through a gas or metal vapor plasma in an enclosed discharge vessel. In order that the light can be used, for example, for imaging in a projection application, the discharge vessel is arranged in a reflector, which concentrates the light and passes it on to a further optical system.

It is known in this respect that some of the radiation emitted by the discharge lamp is reflected back to the discharge lamp by the following optical system. The electrodes of the discharge lamp partially absorb this reflected-back radiation, whereby additional power is introduced into the electrodes along with the power occurring as a result of the electrical operation. This may have the effect that the electrodes heat up considerably, and the temperatures may become so high as to cause the electrodes to deform. This impairs the functionality of the electrodes, and consequently of the discharge lamp; ultimately, failure of the entire illumination unit may result.

A discharge lamp typically has two electrodes arranged lying opposite each other on the optical axis of the reflector. In order to protect particularly the electrode facing the following optical system from reflected-back radiation, the optical axis of the following optical system is typically tilted by an angle of 10° to 30° with respect to the optical axis of the reflector on which the electrodes are arranged. Nevertheless, an introduction of power caused by reflected-back radiation may still be found to occur.

SUMMARY

An illumination unit including a discharge lamp is provided. The discharge lamp may have an electrode, and a reflector with a reflective surface and an optical axis, the electrode having in a sectional plane, which includes the optical axis, a sectional area, and a projection of the reflective surface of one of the halves of the reflector that are separated by the section perpendicularly into the sectional plane along optical paths that are free for the light of the illumination unit resulting in a projected area, wherein the overlap of the projected area and the sectional area is smaller than the area of the electrode in a plane which is perpendicular to the sectional plane and includes the optical axis.

BRIEF DESCRIPTION OF THE DRAWINGS

The invention is explained in more detail below on the basis of exemplary embodiments, the individual features also possibly being essential to the invention in different combinations and implicitly relating to all categories of the invention. In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
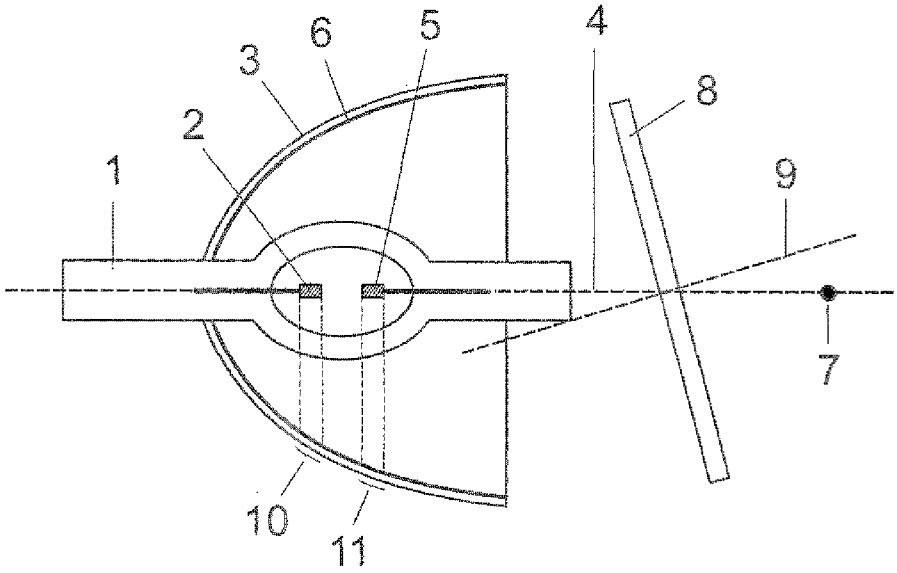
FIG. 1 shows the arrangement of the electrode, the reflector and the following optical system.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide an illumination unit, including a discharge lamp and a reflector, with which the introduction of power caused by reflected-back radiation is reduced.

Various embodiments are based on the recognition that the radiation reflected back by a following optical system with an optical axis tilted with respect to that of the reflector is concentrated in a small region of the reflector, that is to say with an increased irradiation level (radiant power per unit area). The radiation is then directed out of this region into the electrode along a direction which lies substantially perpendicular to the optical axis of the reflector, and has the effect of introducing power into said electrode.

According to various embodiments, the system including the electrode and the reflector is therefore designed such that specifically the absorption of radiation reflected back into the electrode via this region of the reflector is reduced. Hereafter, the region of the reflector in which the reflected-back radiation is concentrated during the application is referred to as the region of concentration, and the direction oriented substantially perpendicularly to the optical axis, along which the radiation is then reflected to the electrode, is referred to as the direction of incidence. This is not necessarily arranged at an angle of 90° to the optical axis, but may also be arranged within an angular range of from 70° to 110°, e.g. 80° to 100°, e.g. 85° to 95°, to the optical axis.

According to various embodiments, the radiation introduced into the electrode via the region of concentration is then reduced by reducing the size of what may be referred to as the absorption cross section of the electrode, that is to say the product of the radiation reflected back along the direction of incidence and the cross section of the electrode seen in the direction of incidence.

For this purpose,

- the electrode may be designed asymmetrically in such a way that the cross-sectional area in a plane perpendicular to the direction of incidence is reduced, so that less absorbent area is therefore available; and/or
- the radiation reflected back out of the region of concentration along the direction of incidence may be reduced by no reflective surface being present in the region of concentration; and/or
- the radiation reflected by the reflective surface along the direction of propagation to the electrode may be reduced by the optical path between the region of concentration and the electrode being interrupted in one region.

This concept is brought together by the features in that the overlap of a sectional area S through the electrode with a projected area P in a sectional plane including the optical axis is considered. The projected area P is in this case a projection of the reflective surface of one of the halves of the reflector that are separated by the sectional plane perpendicularly into the sectional plane along optical paths that are free for the light of the illumination unit. These halves are not necessarily symmetrical to each other, but are quite generally two parts of the reflector that are separated by the sectional plane. Therefore, the half in which the region of concentration is present, or may be present in the application, is projected along the direction of incidence into the sectional plane. It is then characteristic that the overlap of the projected area P and the sectional area S is smaller than the area of the electrode in a plane which is perpendicular to the sectional plane and includes the electrode.

Therefore, if a continuous reflective surface is present in the half of the reflector to be projected (or in that region that is projected onto the sectional area S) and the optical path along the direction of incidence is not blocked, the projected area P is present in the whole of the sectional area S, so that also the overlap of the two areas is not smaller than the sectional area S. The characterizing feature may therefore be satisfied if the sectional area S itself is smaller than the area of the electrode in the plane which is perpendicular to the sectional plane and includes the optical axis.

If the sectional area S and the area of the electrode in the plane perpendicular to the sectional plane and including the optical axis are substantially equal in size, the overlap of the projected area P and the sectional area S may nevertheless become smaller than the area of the electrode in the plane perpendicular to the sectional plane and including the optical axis if no projected area P is present in one region of the sectional area S. This can be achieved, on the one hand, by no surface to be projected, that is to say no reflective surface, being present in the corresponding region of the reflector.

A clearance in the projected area P in the region of the sectional area S can also be achieved, on the other hand, by no free optical path being present, at least partially, for the projection of the reflective surface out of the corresponding region of the reflector into the sectional plane. The radiation is then indeed reflected back via the region of concentration, but is at least partially blocked before it reaches the electrode.

Therefore, the radiation incident at the electrode along the direction of incidence is reduced by the two variants represented in the last two paragraphs, whereas the cross section of the electrode seen in the direction of incidence is reduced in the case of the variant represented in the paragraph before the last two. In various embodiments, it is also possible to use the measures described in the previous paragraphs not only each on their own but in any desired combination.

In the present case, a typical arrangement of the electrode in relation to the reflector was assumed, one in which the optical axis of the reflector passes through the electrode centrally, that is to say, for example, in the case of a rotationally symmetrical electrode, coincides with the axis of rotation thereof. Should the reflector and the electrode be arranged such that the optical axis does not pass through the electrode, or passes through it decentrally, the concept according to the invention would similarly be satisfied if the optical axis were substituted, for example, by the axis of symmetry of the electrode. In the case of a non-rotationally symmetrical electrode, the straight line of intersection of two planes in relation to which the electrode is mirror-symmetrical would have to be chosen, for example, as the axis.

The reflective surface of the reflector is not necessarily reflective within the entire spectral range from infrared through visible to ultraviolet, but may also, in particular, be reflective only in subranges. Furthermore, dependent on the following optical system, the reflected-back radiation may also have a different spectral distribution than the radiation emitted by the discharge lamp. In this connection, free optical paths are considered as unhindered propagation of electromagnetic radiation within a wavelength range, e.g. from infrared to ultraviolet, e.g. in the near infrared and visible range. The interaction with a gaseous medium or the interaction with the plasma of the discharge vessel does not represent a blockage of the propagation of light as intended for the purposes of various embodiments.

Hereafter, no distinction is drawn any longer specifically between the description of the device for reducing the introduction of power and the use aspect of the invention; the disclosure should be understood implicitly with regard to both categories.

In the case of a first embodiment of the illumination unit, the overlap of the projected area and the sectional area S is at least 5%, e.g. at least 20%, e.g. at least 40%, smaller than the area of the electrode in the plane which is perpendicular to the sectional plane and includes the optical axis. If, for example, the projected area P is present in the whole of the sectional area S, it is possible to determine from this the difference in size between the sectional area S and the area of the electrode in the plane perpendicular to the sectional plane and including the optical axis. If, on the other hand, for example, the sectional area S and the area of the electrode in the plane perpendicular to the sectional plane and including the optical axis are of the same size, it is possible, for example, dependent on the specific geometry of the reflector, to deduce the extent of a clearance in the reflective surface.

In a further refinement, it is provided that the electrode has an asymmetric form to such an extent that the sectional area S of the electrode in the sectional plane is smaller than the area of the electrode in the plane which is perpendicular thereto and includes the optical axis. Asymmetric does not necessarily refer here to a geometry without any symmetry, but initially to an electrode that cannot be projected onto itself by rotation about the optical axis through any desired angle. An electrode with an elliptical cross section, for example, seen in the direction of the optical axis, does not have such rotational symmetry, but is mirror-symmetrical in relation to at least two planes (possibly also a further plane perpendicular to the optical axis). However, other forms of electrode are also possible; for example, also electrodes with a rectangular, and at the same time e.g. not square, cross section seen in the direction of the optical axis. In various embodiments, the sectional plane S is smaller than the area of the electrode in the plane perpendicular to the sectional plane and including the optical axis.

In a further refinement, it is provided in this respect that the electrode has, seen in the direction of the optical axis, a (preferably elliptical) cross section with an axial ratio of e.g. 0.1 to 0.9, e.g. of 0.3 to 0.6. The sectional area S may in this case e.g. be mirror-symmetrical to the optical axis, but is not necessarily mirror-symmetrical to an axis perpendicular to the optical axis. The electrode may therefore be formed, for example, such that it is flat on one side, i.e. has an area substantially perpendicular to the optical axis, and may furthermore be formed on the other side such that it tapers toward the optical axis, that is to say runs to a point in the manner of a cone. The axes are in this case the respectively greatest extents in the direction of the greatest cross-sectional extent and perpendicular thereto.

In the case of a further embodiment, it is provided that the electrode has a clearance extending perpendicularly to the sectional plane. The clearance is in this case e.g. provided in such a way that it continuously extends perpendicularly to the sectional plane and at the same time does not touch the optical axis. However, it would also be possible for the clearance to pass through the optical axis, as long as the relation according to various embodiments of the sectional plane S and the area of the electrode is preserved in a plane perpendicular to the sectional plane and including the optical axis.

In the case of another embodiment of the illumination unit, no reflective surface is present in the half of the reflector that is projected into the sectional plane in one region because the projected area P has a clearance in the region of the sectional area S. By the fact that, at least partially, in this region, which overlaps with the region of concentration, no reflective surface facing the electrode is provided, the radiation reflected back to the electrode via this region of the reflector can be reduced.

In a further refinement, no reflective surface is present in the region of the reflector since an absorbent or diffusive element is provided. Such an element may, for example, be applied to the reflective surface or else may be provided in a clearance in the reflective surface on the reflector; it may, furthermore, also be formed by the reflector itself in a clearance in the reflective surface. At the same time, it is also possible for part of the radiation to the electrode to be reflected both by the absorbent element and by the diffusive element, but the reflection with respect to the reflective surface is reduced at least by 20, 50 or 90%, with increasing preference in the sequence given. The diffusion or absorption does not necessarily take place in this case over the entire spectral range of the reflected-back radiation, but is also possible in any portion of the spectrum.

In the case of a further embodiment, no reflective surface is present in the region of the reflector because a hole is provided in the reflector. In this case, therefore, the reflective surface has a clearance, and similarly the reflector has a clearance, the extent of which preferably corresponds substantially to that of the reflective surface. The reflective surface therefore e.g. reaches up to the edge of the hole in the reflector. Dependent on the size of this hole, reflected-back radiation can leave the reflector, whereby it is also possible, for example, to reduce heating up of (non-reflective) wall material. Furthermore, such a hole in the reflector may be formed, for example, as circular, elliptical or else angular, it being possible for a circular hole to be introduced by drilling. The hole may possibly also be put to further use, for example by the electrical supply to the discharge lamp being led through the hole. On account of the concentrated radiant power in this region, e.g. heat-resistant wiring would possibly be necessary for this.

In another refinement, the optical path from the reflective surface along the direction of projection to the electrode is at least partially interrupted. It is therefore possible to provide between the electrode and the reflective surface of the reflector, for example, a diffusive or absorbent element, which at least partially keeps the radiation reflected back via the reflective surface away from the electrode in the manner of a shield, so that the optical path to the electrode is partially interrupted. An interrupting element may in this case be provided, for example, between the discharge vessel of the discharge lamp and the reflector or else be attached to the discharge vessel, for example on the outside.

In the case of a further refinement, which moreover is also regarded as an invention independently of the features of claim 1 and is intended to be disclosed in this form, the electrode has a conical tip with a ratio of height to radius of preferably 1 to 5, e.g. of 2 to 4. The electrode is therefore preferably configured with a truncated cone tip, the lateral surface of which has an angle of e.g. more than 45°, e.g. more than 60°, to the optical axis. In order to reduce the electrical field at the cone tip, a spherical cap may be provided at this location. With an electrode configured in such a truncated manner, the entire electrode body, possibly including a solid cylinder adjoining the cone, may be configured such that it is shortened in a direction along the optical axis. This allows the introduction of reflected-back radiation to be reduced further, it also being possible for an electrode configured in such a shortened manner to be combined with all the measures described above.

Various embodiments also relate to the use of an illumination unit according to various embodiments with an optical unit, an optical axis of the optical unit that is facing the reflector defining with the optical axis of the reflector a plane which is perpendicular to the sectional plane and includes the optical axis. For this purpose, the illumination unit may, for example, be provided with an indication as to how the sectional plane is oriented or along which direction the perpendicular projection takes place. Furthermore, the region of concentration in the reflector may be marked or the length thereof made evident even without marking, for example in the case of a clearance in the reflector. If the normal to the surface of the optical unit that is tilted with respect to the optical axis of the reflector is then aligned in a way according to various embodiments, the reflected-back radiation is concentrated onto the region of concentration and the introduction of power into the electrode is reduced.

In a further refinement of this use, the optical unit is a filter. With such a filter, the radiation emitted by the discharge lamp can be modified in the spectral distribution before further use, for example for illumination in the case of cinematographic or photographic exposures and in the area of surgical operations, as well as a light source for an endoscope, a boroscope or an absorption spectrometer. For this purpose, for example, the intensity in the ultraviolet or near infrared range may be attenuated or even completely blocked.

In a further refinement, the use relates to the fact that the optical unit is a component part of a projector. The optical unit, for example a filter or a color wheel, therefore modifies the light emitted by the discharge lamp for a projection application with which, for example, graphic contents and textual contents can be visualized.

Various embodiments also relate to the use of a discharge lamp with an electrode for an illumination unit according to various embodiments. Therefore, a system including a discharge lamp and a reflector does not necessarily have to be present, but instead the discharge lamp may be provided on its own for the use according to various embodiments. For this purpose, the electrode may, for example, be designed asymmetrically in the way represented above, or the discharge vessel may be provided with a shielding element; the lamp is then sold, for example, with an indication of the orientation of the direction of incidence. Such an indication does not have to be explicitly given in this case, but may, for example, also be provided by an indication with respect to the orientation of the lamp holder in relation to the reflector or in relation to a following optical system.

Furthermore, various embodiments also relate to the use of a reflector with a reflective surface for an illumination unit according to various embodiments. A reflector may, for example, be provided with a hole (or be modified in some other way described above), and, for example, the position of the lamp holder then fixes the position of the electrode with respect to the reflector, so that the features according to various embodiments are satisfied.

FIG. 1 shows an illumination unit including a discharge lamp 1 with an electrode 2 and a reflector 3. The discharge lamp 1 may be, for example, a high-pressure discharge lamp, for instance a mercury vapor high-pressure discharge lamp or sodium vapour high-pressure discharge lamp. The electrode 2 is in this case arranged in the optical axis 4 of the reflector 3, a second electrode 5 being arranged in the discharge lamp 1 lying opposite the first, likewise on the optical axis 4 of the reflector 3. The reflector 3 is provided with a reflective surface 6, which focuses the radiation emitted by the discharge lamp 1 on a focal point 7. The reflector 3 could be, for example, a coated plastics material or else be produced from a reflective material (possibly dependent on the nature of the surface), for example a metallic material. Arranged within the focal length of the reflector 3 is a following optical system 8, the optical axis 9 of which is tilted with respect to the optical axis 4 of the reflector 3. If the following optical system 8 is a filter with a planar area facing the reflector 3, the optical axis 9 of the filter corresponds to a normal to the planar area.

The two-dimensional representation from FIG. 1 can be obtained from a three-dimensional arrangement by considering a section in the plane formed by the two optical axes 4 and 9.

In the case of such an arrangement, radiation reflected back by the following optical system 8 is introduced into the electrode 2 particularly via a region 10 of the reflective surface 6. According to a refinement, this introduction of radiation is reduced by, at least partially, in the region 10, no reflective surface 6 being present or by a hole being provided in the reflective surface 6 and the reflector 3. In this case, a hole may also be provided for the second electrode 5 in a way according to various embodiments at the corresponding location 11, or else a single hole may be provided in such a way that it reaches into the regions 10 and 11 and, furthermore, extends over a region lying between said regions.

Figure 2:
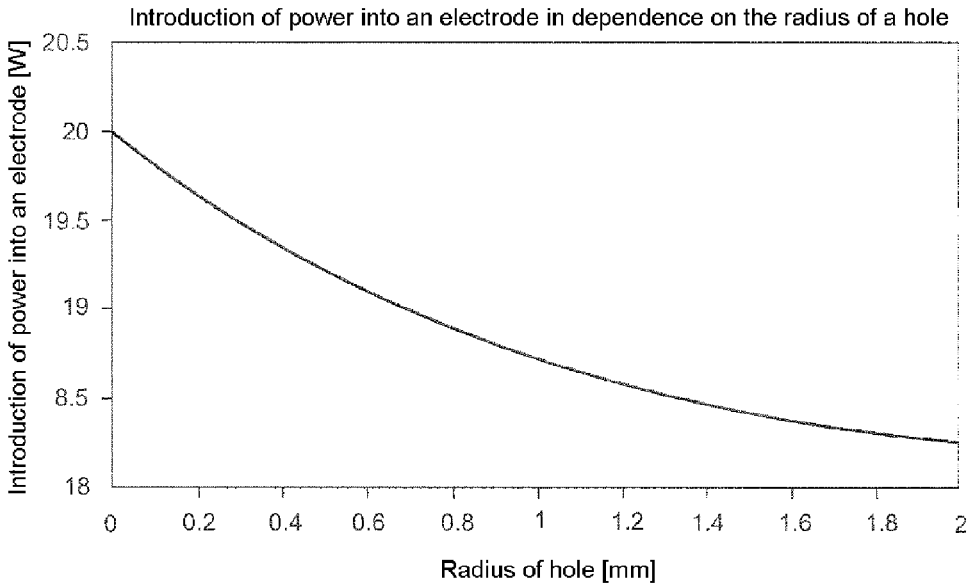
FIG. 2 illustrates the reduction of the introduction of power in dependence on the radius of the hole.

FIG. 2 shows as a result of a simulation the introduction of power into an electrode 2 in watts, in dependence on the radius of a hole in the reflector 3. The reduction of the power introduced that is shown is obtained if the hole is provided in a way according to various embodiments in the region of the reflector in which the reflected-back radiation is present in a concentrated form.

Figure 3:
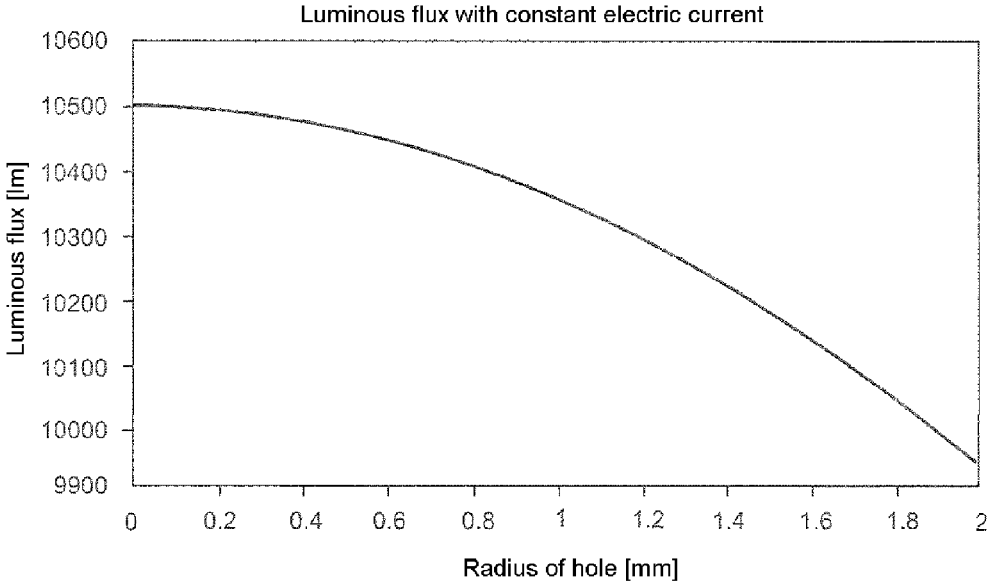
FIG. 3 shows the emitted luminous flux in dependence on the radius of the hole.

FIG. 3 shows the luminous flux in lumens emitted by the discharge lamp via the reflector 3, in dependence on the radius of a hole in the reflector 3. The figure illustrates that the luminous flux, and consequently the light yield, of the reflector 3 decreases only slightly for small radii of holes, but then drops in a way represented as the radius of the hole increases. If, for example, a hole with a radius of less than 1 millimeter is provided in a way according to various embodiments in the region of concentration, the introduction of power into the electrode can be reduced significantly (compare the exponential drop in FIG. 2), the luminous flux emitted by the discharge lamp via the reflector remaining virtually unchanged. In the case of a radius of a hole of one millimeter, for example, the introduction of power decreases by 6%, whereas the luminous flux emitted decreases only by 1%.

Figure 4:
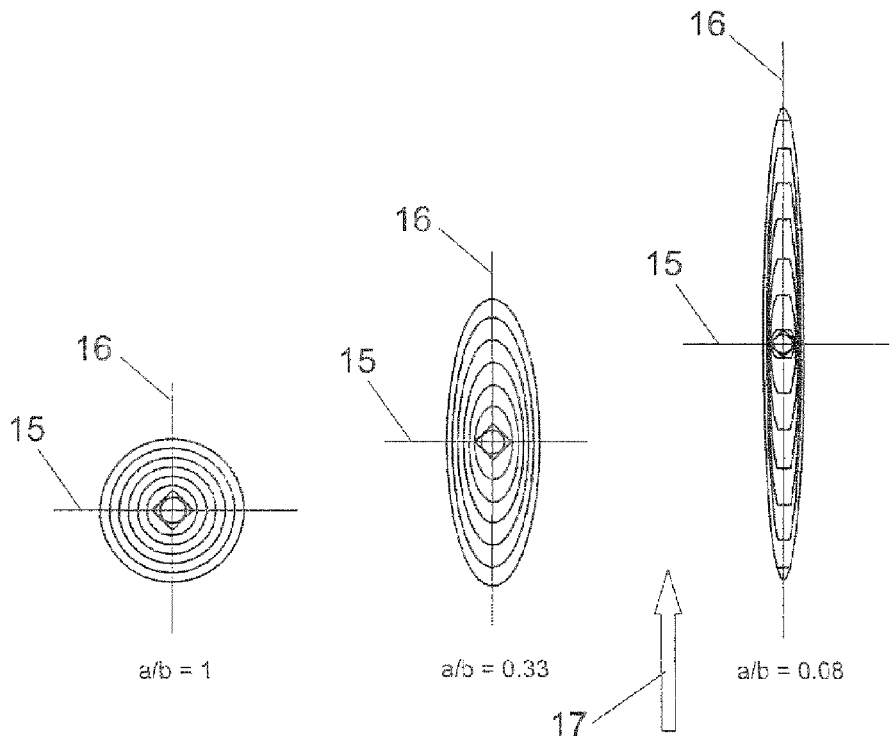
FIG. 4 illustrates various cross-sectional forms of the electrodes.

FIG. 4 shows various forms of electrodes 2, seen along the optical axis 4, one circular cross section and two elliptical cross sections. The sectional plane 15 and the plane 16 perpendicular to the sectional plane 15 and including the optical axis 4 are oriented perpendicularly to the plane of the drawing. To simplify matters, it is assumed hereafter that the electrodes 2 are formed by an extrusion of the cross section in a direction perpendicular to the plane of the drawing, so that, in the case of the electrode 2 on the left, the area in the sectional plane 15 and in the plane 16 perpendicular thereto are equal in size. On the other hand, the electrodes 2 in the middle and on the right are modified in a way according to various embodiments such that, on account of the elliptical cross section, the sectional area S in the sectional plane 15 is smaller than the area of the electrode 2 in the plane 16 perpendicular thereto. The sectional area is smaller than the area of the electrode 2 in the plane 16 perpendicular thereto by approximately 67% in the case of the electrode 2 in the middle and by approximately 92% in the case of the electrode 2 on the right. The radiation reflected back by the region of concentration of the reflector 3 and introduced into the electrode can then be reduced according to various embodiments by such an electrode 2 being aligned in such a way that the long axis points in the direction of the direction of incidence 17.

Figure 5:
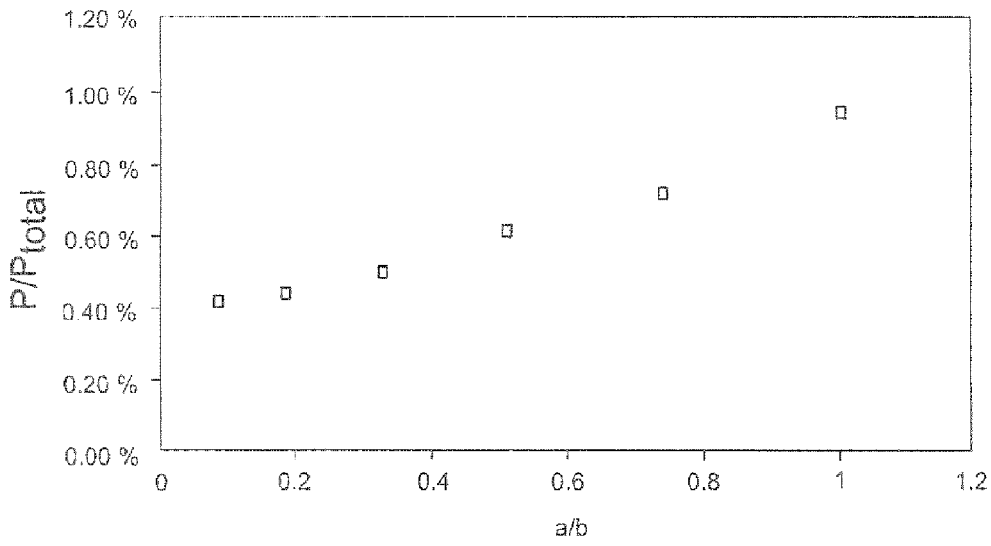
FIG. 5 shows the introduction of power with respect to the total radiant power of a discharge lamp for various cross-sectional forms.

FIG. 5 shows the simulated introduction of power into the electrode for the cross-sectional profiles represented in FIG. 4 and for further cross-sectional profiles with other axial ratios. The optical axis 9 of the following optical system 8 is in this case tilted by 20% in relation to the optical axis 4 of the reflector 3 and, in a way according to various embodiments, runs in the plane 16 perpendicular to the sectional plane 15. The long axis of the electrode is therefore oriented with respect to the region of concentration along the direction of propagation 17. The figure illustrates that, with a ratio of the short axis to the long axis of just one third (compare electrode in the middle in FIG. 4), the introduction of power into the electrode can be approximately halved.

Figure 6:
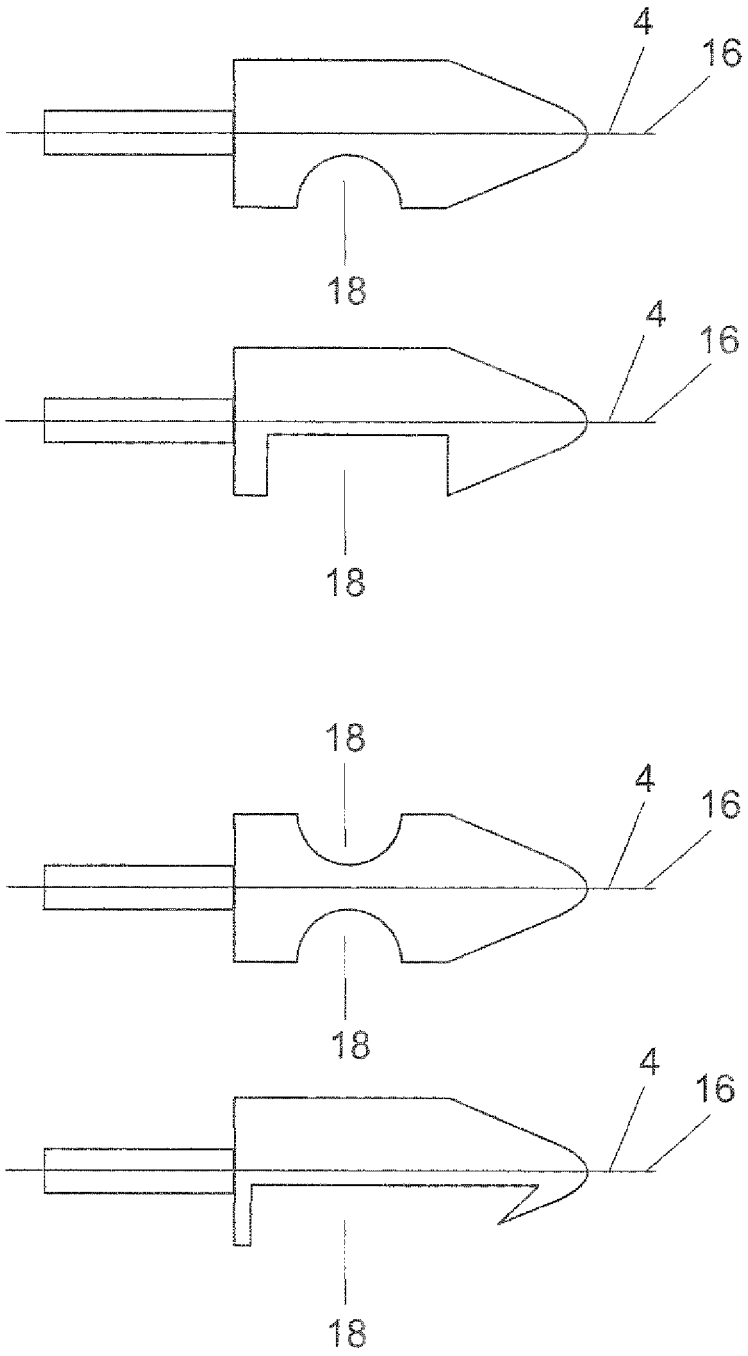
FIG. 6 illustrates various clearances in electrodes.

FIG. 6 shows electrodes 2 with variously configured clearances 18. The plane of the drawing in this case represents the sectional plane 15; the plane 16 perpendicular thereto and including the optical axis coincides in this representation with the optical axis 4. The clearances 18 of the electrodes are in this case arranged in such a way that the sectional area S becomes smaller in each case than the area of an electrode in the plane 16 perpendicular to the plane 15. The orientation according to various embodiments of the electrode 2 can then in turn be used to reduce the radiation reflected back by the region of concentration 10 and introduced into the electrode 2.

Figure 7:
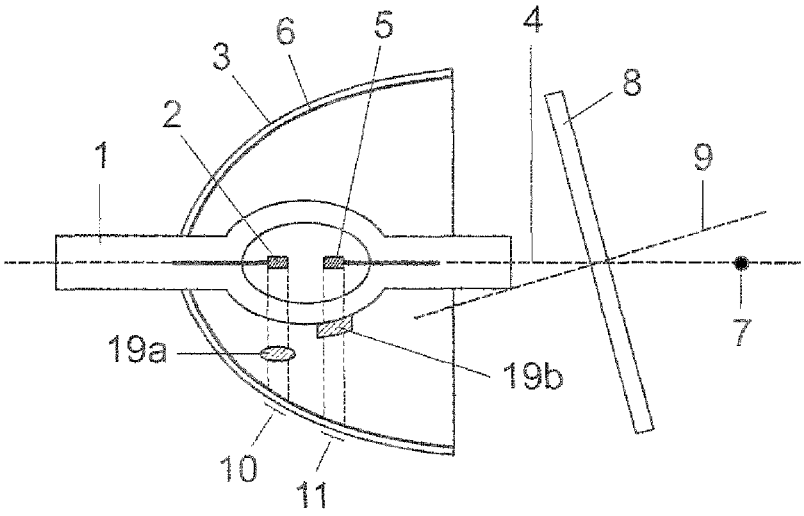
FIG. 7 shows the shielding of reflected-back radiation.

FIG. 7 shows how the radiation reflected back by the following optical system 8 in the direction of the electrodes 2 or 5 via the regions 10 or 11 of the reflector 3 is blocked by a diffusive or absorbent element 19. In the figure, such an element is provided between the discharge lamp 1 and the reflective surface 6 and is fastened by a holder on the reflector 19*a*, so that the propagation of light from the region 10 to the electrode 2 is blocked. Similarly, the propagation of light from the region 11 to the electrode 5 is blocked by the diffusive element 19*b* being provided on the outside of the discharge vessel of the lamp 1.

Figure 8:
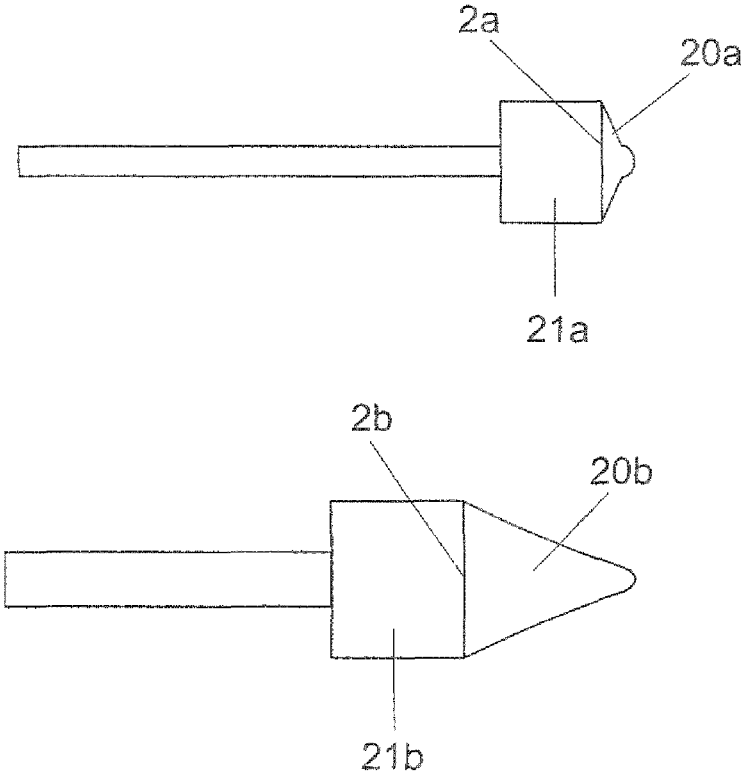
FIG. 8 illustrates an electrode with a cone form configured in a truncated manner.

FIG. 8 shows two electrodes 2 with differently formed cone tips 20, the upper one having a truncated cone tip 20*a* with a ratio of height to radius of 4, whereas the lower one has a pointed cone tip 20*b* with a ratio of height to radius of 0.5. The truncated cone form 20*a* has a better thermal bond with the main mass of the electrode body 21*a*, so that the introduction of electrical power at the tip corresponds to that of the electrode 2*b* with a pointed cone form 20*b*. The truncated cone form 20*a* allows the electrode 2*a* as a whole to be made more compact, so that also the sectional area S in the sectional plane becomes smaller than the sectional area S of the electrode 2*b* with a pointed cone form 20*b*. The introduction of power is therefore also reduced by a truncated cone form 20*a* alone, but this can also be combined with other features of various embodiments.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An illumination unit comprising a discharge lamp with an electrode, and a reflector with a reflective surface and an optical axis, the electrode having in a sectional plane, which includes the optical axis, a sectional area, and a projection of the reflective surface of one of the halves of the reflector that are separated by the section perpendicularly into the sectional plane along optical paths that are free for the light of the illumination unit resulting in a projected area, wherein the overlap of the projected area and the sectional area is smaller than the area of the electrode in a plane which is perpendicular to the sectional plane and includes the optical axis.

2. The illumination unit as claimed in claim 1, wherein the overlap of the projected area and the sectional area is at least 5% smaller than the area of the electrode in the plane which is perpendicular to the sectional plane and includes the optical axis.

3. The illumination unit as claimed in claim 2, wherein the overlap of the projected area and the sectional area is at least 20% smaller than the area of the electrode in the plane which is perpendicular to the sectional plane and includes the optical axis.

4. The illumination unit as claimed in claim 3, wherein the overlap of the projected area and the sectional area is at least 40% smaller than the area of the electrode in the plane which is perpendicular to the sectional plane and includes the optical axis.

5. The illumination unit as claimed in claim 1, wherein the electrode has an asymmetric form to such an extent that the sectional area of the electrode in the sectional plane is smaller than the area of the electrode in the plane which is perpendicular thereto and includes the optical axis.

6. The illumination unit as claimed in claim 5, wherein the electrode has, seen in the direction of the optical axis, a cross section with an axial ratio of 0.1 to 0.9.

7. The illumination unit as claimed in claim 6, wherein the electrode has, seen in the direction of the optical axis, an elliptical cross section with an axial ratio of 0.1 to 0.9.

8. The illumination unit as claimed in claim 6, wherein the electrode has a cross section with an axial ratio of 0.3 to 0.6.

9. The illumination unit as claimed in claim 5, wherein the electrode has a clearance extending perpendicularly to the sectional plane.

10. The illumination unit as claimed in claim 1, wherein no reflective surface is present in the half of the reflector that is projected into the sectional plane in one region such that the projected area has a clearance in the region of the sectional area.

11. The illumination unit as claimed in claim 10, wherein no reflective surface is present in the region of the reflector because an absorbent or diffusive element is provided.

12. The illumination unit as claimed in claim 10, wherein no reflective surface is present in the region of the reflector because a hole is provided in the reflector.

13. The illumination unit as claimed in claim 1, wherein the optical path from the reflective surface along the direction of projection to the electrode is at least partially interrupted.

14. The illumination unit as claimed in claim 1, wherein the electrode has a conical tip with a ratio of height to radius of 1 to 5.

15. The illumination unit as claimed in claim 14, wherein the electrode has a conical tip with a ratio of height to radius of 2 to 4.

16. The use of an illumination unit as claimed in claim 1 with an optical unit, an optical axis of the optical unit that is facing the reflector defining with the optical axis a plane which is perpendicular to the sectional plane and includes the optical axis.

17. The use as claimed in claim 16, the optical unit being a filter.

18. The use as claimed in claim 16, the optical unit being a component part of a projector.

19. The use of a discharge lamp with an electrode for an illumination unit, the illumination unit comprising a discharge lamp with an electrode, and a reflector with a reflective surface and an optical axis, the electrode having in a sectional plane, which includes the optical axis, a sectional area, and a projection of the reflective surface of one of the halves of the reflector that are separated by the section perpendicularly into the sectional plane along optical paths that are free for the light of the illumination unit resulting in a projected area, wherein the overlap of the projected area and the sectional area is smaller than the area of the electrode in a plane which is perpendicular to the sectional plane and includes the optical axis.

20. The use of a reflector with a reflective surface for an illumination unit, the illumination unit comprising a discharge lamp with an electrode, and a reflector with a reflective surface and an optical axis, the electrode having in a sectional plane, which includes the optical axis, a sectional area, and a projection of the reflective surface of one of the halves of the reflector that are separated by the section perpendicularly into the sectional plane along optical paths that are free for the light of the illumination unit resulting in a projected area, wherein the overlap of the projected area and the sectional area is smaller than the area of the electrode in a plane which is perpendicular to the sectional plane and includes the optical axis.

* * * * *